United States Patent [19]

Crowley et al.

[11] Patent Number: 4,605,330

[45] Date of Patent: Aug. 12, 1986

[54] DISPENSING CONTAINER FOR STICK-SOLIDS

[75] Inventors: Michael J. Crowley, Maineville; Arthur H. Dornbusch; Paul J. Green, both of Cincinnati, all of Ohio

[73] Assignee: The Procter & Gamble Company, Cincinnati, Ohio

[21] Appl. No.: 644,429

[22] Filed: Aug. 27, 1984

[51] Int. Cl.[4] ..... B43K 21/08; B43K 5/06

[52] U.S. Cl. ..... 401/68; 401/75; 401/78; 401/175

[58] Field of Search ..... 401/68, 73, 75, 78, 401/175, 172, 79, 98, 171, 174, 176; 222/390; 221/279

[56] References Cited

U.S. PATENT DOCUMENTS

| | | | |
|---|---|---|---|
| 1,675,365 | 7/1928 | McAtree . | |
| 1,760,404 | 5/1930 | Funk | 222/390 |
| 1,943,893 | 1/1934 | Johnson | 15/137 |
| 2,728,097 | 12/1955 | Seifert | 15/137 |
| 2,816,309 | 12/1957 | Worth et al. | 15/137 |
| 2,818,167 | 12/1957 | McKinley | 401/175 |
| 2,855,632 | 10/1958 | Croce et al. | 18/59 |
| 2,879,548 | 3/1959 | Croce et al. | 18/59 |
| 2,917,765 | 12/1979 | Jakubowski | 401/175 |
| 2,935,191 | 5/1960 | Leshin | 206/56 |
| 2,980,246 | 4/1961 | Leshin | 206/56 |
| 3,008,172 | 11/1961 | Thompson | 15/547 |
| 3,333,740 | 8/1967 | Waller | 401/75 |
| 3,567,293 | 5/1968 | Salcman | 221/279 |
| 3,612,705 | 10/1971 | Duval | 401/75 |
| 3,917,417 | 11/1975 | Lang | 401/75 |
| 4,232,977 | 11/1980 | Chutter | 401/69 |
| 4,298,036 | 11/1981 | Horvath | 141/1 |
| 4,369,158 | 1/1983 | Woodruff et al. | 264/268 |
| 4,545,696 | 10/1985 | Carluccio | 401/175 |

FOREIGN PATENT DOCUMENTS

| | | |
|---|---|---|
| 2651869 | 5/1978 | Fed. Rep. of Germany . |
| 2807472 | 8/1979 | Fed. Rep. of Germany . |

*Primary Examiner*—Richard J. Apley
*Assistant Examiner*—Alfedo Acoff
*Attorney, Agent, or Firm*—Richard C. Witte; John V. Gorman; Ronald J. Snyder

[57] ABSTRACT

A dispensing container for solid stick-type products is described which is adapted to be bottom filled with molten solid stick-type product while in a completely assembled condition. The dispensing container includes a substantially tubular container body having an open upper end and a base member with an aperture formed therethrough mounted in its lower end. A cup-shaped closure cap telescopes over the upper end of the dispensing container. A threaded follower having an at least partially open skeletal structure adapted to permit axial flow of molten solid-stick product therethrough during filling operations is slidably and non-rotatably disposed within the container body for axial movement therewithin. Means are provided to manually vary the axial position of the follower within the container body, with those varying means including an externally threaded screw stem having cooperative engagement with the follower, rotating means disposed on the lower exterior of the container body and extending into the container body through the aperture formed in the base member, and skeletal structured mounting means attaching the screw stem to the rotating means thereby permitting axial flow of molten solid-stick product therethrough during filling operations. The rotating means is also formed with a bore providing fluid communication from the exterior to the interior of the container body. The fully assembled dispensing container can be bottom filled with molten product and requires no further assembly or closure thereafter.

15 Claims, 5 Drawing Figures

Fig. 2
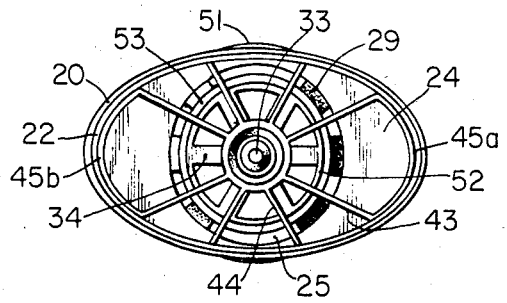
Fig. 3
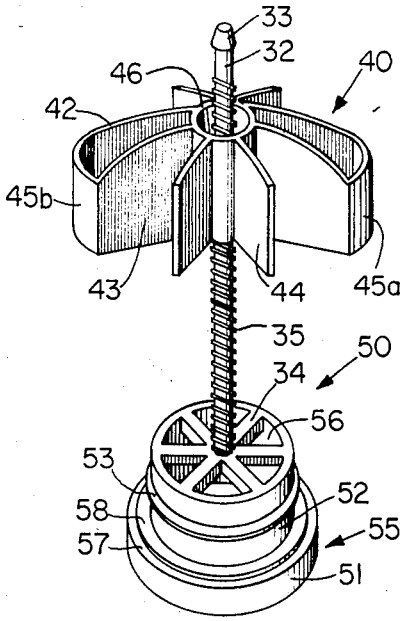
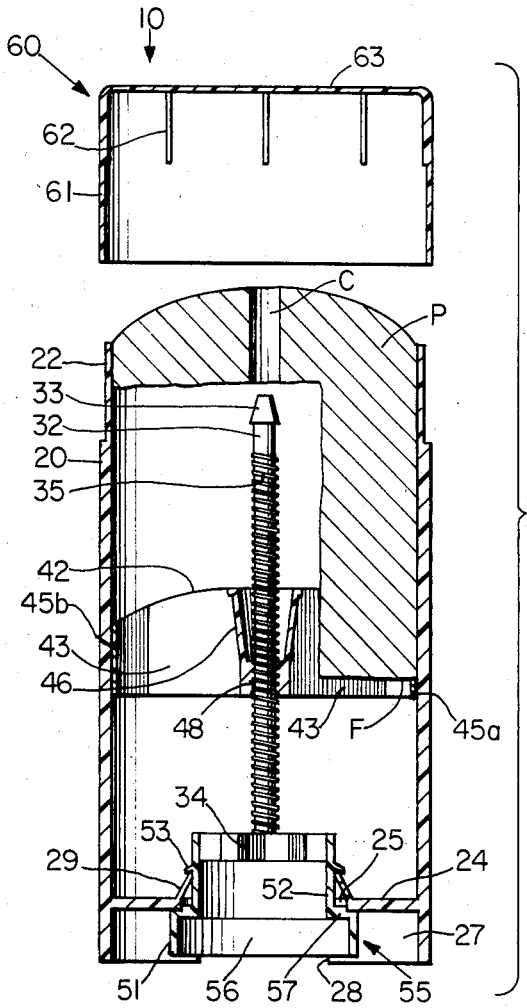
Fig. 1
Fig. 4
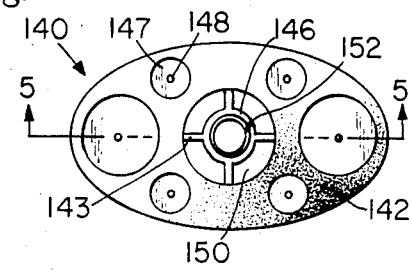
Fig. 5
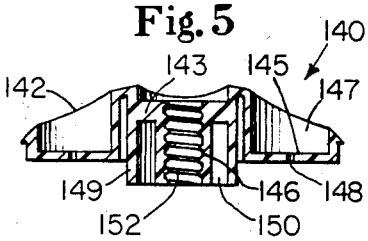

DISPENSING CONTAINER FOR STICK-SOLIDS

TECHNICAL FIELD

This invention relates to a dispensing container for stick-solid products, and, more particularly, to a dispensing container adapted to be filled with molten stick-solid product while in a fully assembled inverted condition.

BACKGROUND ART

Dispensing containers for stick-type solid products are relatively abundant in the art. U.S. Pat. No. 2,980,246, which issued to J. Leshin on Apr. 18, 1961, for example, discloses a container-dispenser for solid stick products featuring a product follower constructed in a skeleton form in order to embed itself in the stick product when molded in the container. The Leshin patent contemplates pouring molten solid-stick product directly into the assembled container through its open upper end, with the molten material thereafter hardening to form the stick-solid product therein.

The art also shows stick-solid packages adapted to be filled in inverted condition via the bottom of the package. Such a package is disclosed in U.S. Pat. No. 4,369,158, which issued to Woodruff et al. on Jan. 18, 1983. In this patent, a stick antiperspirant package having generally open ends is fitted with a pouring cap mold on its upper end, and inverted for filling with molten product through its open bottom end. Immediately following the pouring of the molten material through the open bottom, a preassembled twist-up assembly is inserted therein. After solidification of the molten material, the pouring cap is removed and the upper end of the container is then covered by a separate cap. U.S. Pat. No. 4,298,036, which issued to William Horvath on Nov. 3, 1981, also shows a dispenser for stick solids which can be filled in the inverted position through its hollow base and stem structure. Horvath contemplates pouring molten product through its hollow central screw stem, while allowing air within the package to escape through vent holes formed in its plunger and base structures.

An oval cross-section stick-solid twist-up package is manufactured by Calumet Manufacturing Co. (East Orange, N.J.) and features a fully-assembled bottom fill design. The Calumet package comprises an oval shaped container body having a central aperture through a substantially closed bottom wall. A generally hollow screw knob is mounted on the exterior of the bottom wall and has a tubular internally threaded sleeve-like member which extends into the container body through the central aperture thereof. Mounted within the container body is a follower having a flat upper surface, a central bore, and an externally threaded tubular sleeve member which depends from adjacent the central bore and telescopes into the sleeve-like member of the screw knob for threaded interaction therewith. Rotational movement of the screw knob thereby axially displaces the follower within the container. A closure cap telescopes over the upper end of the container body thereby closing the package. Molten product is poured into the inverted assembled container through the hollow screw knob, through the sleeve members and through the central bore of the follower. Several vents are provided in the flat surface of the follower to allow escape of displaced air during the filling procedure. The telescoping sleeve members of the Calumet package, however, occupy a large portion of the package and prevent the follower from being fully retracted therewithin.

Despite all the prior work done in this area, as evidenced by the above-cited patents, there remain problems of manufacturing complexity, speed and efficiency, and excessive costs of such packages.

DISCLOSURE OF THE INVENTION

It is an object of this invention to obviate the above-described problems.

It is another object of the present invention to provide a more economical and efficient dispensing container for stick-solid products which can be bottom filled in fully assembled condition on high speed automatic packing machines.

In accordance with one aspect of the present invention, there is provided a dispensing container for solid stick-type products having a substantially tubular container body with an open upper end and having a base member mounted in its lower end, with such base member having an aperture formed therethrough. The container includes an internally threaded follower which is slidably and non-rotatably disposed in the container body for axial movement therein, and this follower is formed with a skeletal structure adapted to permit flow through of molten solid stick product during filling operations and later embedment in and adherence to the solidified stick product. Means to vary the axial position of the follower within the container body are provided and include an externally threaded screw stem adapted for cooperative engagement with the follower, and a rotating means disposed on the lower exterior of the base member of the container body and extending into the container body through the aperture. The rotating means has a bore formed therethrough to provide fluid communication from the exterior to the interior of the container body. The screw stem is attached to the rotating means by skeletal-structured mounting means in order to permit axial flow of molten solid-stick product through the bore and the mounting means during filling operations.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

FIG. 1 is an exploded front vertical section taken through the center of an embodiment of the dispensing container of the subject invention with the product P partially broken out for clarity;

FIG. 2 is a top plan view of the dispensing container of FIG. 1 with the cap removed;

FIG. 3 is a fragmentary perspective view of the elevating mechanism assembly and follower of the dispensing container of FIG. 1;

FIG. 4 is a top plan view of a preferred embodiment of the follower of the subject invention; and FIG. 5 is a vertical section of the follower of FIG. 4 taken along line 5—5 of FIG. 4.

DETAILED DESCRIPTION OF THE INVENTION

Referring now to the drawings in detail, wherein like numerals indicate the same elements throughout the views, FIGS. 1 through 3 illustrate an embodiment of a dispensing container of the present invention. Container 10 of FIGS. 1 through 3 may be formed of any resilient plastic material or the like, such as polyethylene or polypropylene, and includes a substantially tubular container body 20 for the solid stick-type product P to be dispensed, an internally threaded follower 40, a screw-type elevating mechanism assembly 50, and a closure cap 60. In FIG. 1, solid product P has been partially broken away to reveal more detail of container 10. Further, follower 40 is pictured in FIG. 1 as it would appear after being moved axially upward within container 10 to permit dispensing of a portion of product P.

The container body 20 has an open upper end and is substantially closed near its lower end by base member 24. Base member 24 may be integrally formed with container body 20 and has an aperture 25 formed therein for insertion therethrough of a screw-type elevating mechanism assembly 50, as will be described in greater detail below. Aperture 25 is illustrated as preferably being located centrally in base member 24. Extending upwardly and slightly inwardly from adjacent aperture 25, on the inner surface of base member 24, are the locking tabs 29. As shown in FIGS. 1 and 2, locking tabs 29 may be evenly spaced about aperture 25 and are designed to interlock with retaining shoulder 53 of elevating mechanism 50, to thereby securely and rotatably hold elevating mechanism 50 within container body 20. It should be understood that the precise details of rotatably locking the elevating mechanism assembly within the container body are not critical and can be accomplished by other means known or conceivable to one skilled in the art. In this regard, locking tabs 29 need not be individual tabs and could be formed as a more continuous structure (not shown). Utilization of individual spaced locking tabs 29, however, is a preferred manner of achieving the desired locking interaction while minimizing materials necessary and overall package costs.

As shown in FIG. 1, base member 24 may be mounted a certain distance from the lower end of container body 20 thereby creating a recessed portion 27 on the lower exterior end of container body 20. Such recessed portion 27 is not critical, however, it is preferred to create a receptacle wherein knob 51 of elevating mechanism 50 may be contained while permitting dispensing container 10 to stand upright on substantially uniform lower edges of container body 20. As best seen in FIG. 1, the central portions of container body 20 extending below base member 24 are preferably removed (shown at 28 of FIG. 1) to facilitate access to knob 51 of the elevating mechanism assembly 50. As illustrated in FIG. 2, the removed portions of container body 20 may also permit an oversized knob 51 to extend slightly beyond the outer surface of container body 20 to further facilitate manual operation thereof by the consumer. Knob 51 need not be round in conformation, however, its size and shape must permit the consumer to apply rotational force relative to the container body in order to operate the dispensing container, as will be described below.

the upper portions of container body 20 exhibit a thinned or undercut portion 22 to accommodate closure cap 60. Again, undercut portion 22 is shown only as an example of a preferred means of securing a closure cap to the upper surfaces of the dispensing container. Other means of mounting a closure cap (e.g. external threads, snap-closures) may be equally utilized. It should also be noted that, while FIGS. 1 and 2 illustrate a container body having an oval configuration, other configurations (e.g. round or square) known or conceivable to one skilled in the art could easily be substituted therefor.

Closure cap 60 is illustrated as being of generally cup-shaped configuration and is designed for telescopic mounting over the upper surfaces of container body 20. Closure cap 60 is shown as having a substantially flat closed top surface 63, a peripheral skirt 61 depending from top surface 63, and a plurality of internal spacing ribs 62 formed on the inner surface of peripheral skirt 61. Spacing ribs 62 are designed to help retain closed top surface 63 a predetermined distance above the top edge of container body 20. Any snug-fitting closure cap of similar construction could be used, and the friction fit of closure cap 60 with the upper undercut portion 22 of container body 20 could be replaced by appropriate threaded or snap-type closure means.

Screw-type elevating mechanism assembly 50 is shown in FIGS. 1 and 3 as comprising a knob 55 having a central bore 56 formed therethrough, an externally threaded screw stem 32 extending upwardly from the center of bore 56, and a plurality of spoke-like supports 34 connecting the lower end of screw stem 32 to the upper inner surfaces of bore 56. As seen best in FIG. 1, knob 55 has a generally hollow configuration and comprises a lower skirt-like peripheral wall 51 forming a rotating means for the elevating mechanism assembly 50. The outer surfaces of peripheral wall 51 may be formed with external ribs (not shown) or other embossments to facilitate tactile manipulation by the consumer during operation of the dispensing package. The upper portion of the peripheral wall 51 is integrally formed with inwardly extending flange 57, which is in turn connected to an upwardly extending peripheral wall 52. Flange 57 could also be formed separately and attached to the upper portion of peripheral wall 51 and the lower portion of upwardly extending wall 52 by adhesive or any other means of attachment, but it is preferred that these pieces be formed as a single unit. Additionally, a peripheral ridge 58 is formed on the upper surface of flange 57 adjacent the outer surface of the lower portion of peripheral wall 52. Ridge 58 is not critical, but preferably serves to provide a smoother alignment and bearing surface for knob 55 within aperture 25 (as best seen in FIG. 1). As also seen in FIG. 1, the outside diameter of flange 57 and peripheral wall 51 is somewhat larger than the aperture 25 of base member 24, thereby confining the rotating means of elevating mechanism 50 to the exterior of container body 20. Formed on the upper outer surface of peripheral wall 52 is a retaining shoulder 53 designed to snap past locking tabs 29 and thereby lock elevating mechanism assembly 50 within container body 20. As mentioned earlier, the precise details of the manner in which elevating mechanism assembly 50 is rotatably mounted within container body 20 is not critical and can be achieved by various means known or conceivable by one skilled in the art.

Adjacent the inner upper surfaces of peripheral wall 52, the spoke-like radially disposed support arms 34 connect screw stem 32 to peripheral wall 52 without substantially impeding the open area of bore 56. FIGS. 2 and 3 illustrate six (6) radially extending support arms 34 connecting screw stem 32 to peripheral wall 52, however, the relative number and size of support arms 34 could be varied as appropriate for specific applications, as long as bore 56 remains substantially open. It is essential that screw stem 32 be attached to the rotating means of elevating mechanism 50 by such skeletal-structured mounting means in order to permit axial flow of molten solid-stick product through bore 56 and through the mounting means 34 during filling operations.

Screw stem 32 is formed with external threads 35 which correspond to the internal threads of follower 40, described below. Elevating mechanism assembly 50 can be integrally formed as a single piece, and is to be snapped into aperture 25 and locked therewithin for rotatable movement relative to the container body 20.

Once elevating mechanism assembly 50 is locked into its rotatable position within container body 20, the internally threaded follower 40 is placed onto the upper portions of screw stem 32 within container body 20 and threadedly retracted onto screw stem 32 until it is in a substantially fully retracted position. It is preferred that the distal tip 33 of screw stem 32 be formed of slightly larger diameter (as shown in FIGS. 1 and 3) than the balance of screw stem 32 in order to act as a detent to prevent removal of follower 40 once it has been snapped past the tip 33. Follower 40 features a generally skeletal structure which is adapted to permit axial flow of molten solid-stick product therethrough during filling operations. With follower 40 substantially fully retracted on screw stem 32 within container body 20, substantially the entire inner volume of container body 20 may be filled with molten solid-stick product thereby minimizing wastage of container space, reducing needless container costs, and producing a more efficient dispensing container. The skeletal structure also permits follower 40 to embed in and adhere to the solidified stick product as the molten product cools within the dispensing container. Any at least partially open skeletal structure which permits such axial flow during filling operations and provides good structure for embedment in and adherence to solidified stick product can be used for follower 40, and the specific structure shown and described herein is meant only to provide an example of such structure. A particularly preferred structure of the follower is described below with respect to FIGS. 4 and 5.

As shown best in FIG. 3, follower 40 includes a plurality of radially disposed fin-like elements (fins) 43 and 44 connected to a central core 46. Major fins 43 are slightly longer than minor fins 44, and they extend in a direction generally corresponding to the major axis of the oval cross section of container body 20. As seen in FIG. 2, the outer dimensions of follower 40 conform substantially to the inner surfaces of container body 20. As shown in FIGS. 2 and 3, respective pairs of right and left major fins 43 are connected at their distal ends by right and left follower side walls 45*a* and 45*b*, respectively, with such follower side walls 45*a* and 45*b* substantially conforming to the inner surface of container body 20. Minor fins 44 may also be shaped and/or connected at their distal ends to similarly conform to at least a portion of the inner surfaces of a container body. As can be seen in FIGS. 1 and 3, the upper edges 42 of fins 43 and 44 are curved such that the effective upper surface of follower 50 is dome-shaped. Such curved upper surface is preferred for followers to be used for dispensers of products such as solid antiperspirant and deodorant packages to maximize consumer comfort and to minimize product waste.

An example of a particularly preferred follower is illustrated in FIGS. 4 and 5. Follower 140 exhibits a skeletal structure only in its central portions, while the balance of its upper surface 142 is substantially closed and formed with product anchoring depressions or sockets 147. Upper surface 142 is substantially dome-shaped and features a central bore 150 formed therethrough. Within bore 150, central core 146 is affixed by a plurality of radially disposed supports 143. Central core 146 includes internal threads 152 designed for threaded interaction with a screw stem, such as screw stem 32 described above. Supports 143 can be any skeletal-type structure which can provide adequate support for attaching core 146 within bore 150 without substantially impairing axial flow of molten solid-stick product therethrough during filling operations. A substantially tubular wall 149 depends from the lower central portions of upper surface 142, and the inner surfaces of tubular wall 149 define bore 150. The diameter of bore 150 is preferably dimensioned to correspond to the inside diameter of the open area or bore of the elevating mechanism (e.g. bore 56 of elevating mechanism 50) in a dispensing container as described herein, so that when follower 140 is fully retracted within the container prior to the filling operation, bore 150 and the open area of the elevating mechanism (e.g. bore 56) form a substantially continuous fill channel into the container.

Located in various positions about bore 150 on the upper surface 142 of follower 140 are a plurality of depressions or sockets 147 having small vent holes 148 through their bottom surfaces 145. Sockets 147 provide enhanced anchoring of the solidified solid-stick product to follower 140. Vent holes 148 permit the escape of trapped air within the container during bottom filling operations, and thereby allow molten solid-stick product to enter sockets 147 for increased product adherence to follower 140. Number, size and location of sockets 147 may be varied as appropriate in order to provide adequate product support and adherence, while minimizing product waste. The assembly and function of follower 140 within a container body is essentially identical to that described herein with respect to follower 40 and container body 20.

Because of the oval shape of container 20 and follower 40 (or 140), the follower is prevented from rotation within container body 20 and can be easily advanced or retracted on screw stem 32 by the application of rotational movement via elevating mechanism assembly 50. It can be seen that if the follower did not adequately correspond to the shape of the inner surfaces of container body 20, or if the dispensing container were formed of a more circular cross-section, means to prevent relative rotation between such follower and container body 20 may be required. Means to prevent relative rotation of the follower within the dispenser, such as a groove and rib arrangement, are well known in the industry.

In use, dispensing container 10 is fully assembled by snapping elevating mechanism 50 into container body 20 as described, inserting follower 40 (or 140) into the upper portions of container body 20, preferably fully retracting follower 40 onto screw stem 32 such that follower 40 is in its lowestmost position within container body 20, and thereafter telescoping closure cap 60 over the undercut upper portion 22 of container body 20. The completely assembled dispensing container 10 is then inverted and bottom filled with molten solid-stick product through bore 56, through the skeletal mounting means 34, and through the skeletal structure of follower 40. Sufficient molten product is thereby introduced to fill dispensing container 10 approximately to fill line F as shown in FIG. 1 (if follower 140 were used, sufficient molten product would be introduced to ensure that such molten product would substantially fill the sockets 147). Thereafter, the filled dispensing container 10 is held in inverted position until such molten solid-stick product has solidified. The filled dispensing container is now ready to be shipped and/or sold as a finished product. As seen in FIG. 1, a small channel C will be present in at least a portion of solid product P as it is dispensed as a result of the axial movement of product P relative to the axially stationary screw stem 32.

Depending upon product P volatility, fragrance, etc. and other factors such as shipping and handling conditions and aesthetic requirements, an additional closure seal (not shown) might preferably be placed within knob 55 to cover bore 56 from the exterior after filling is completed. Such a seal could be made of paper, plastic, wax, or other appropriate materials.

Various modifications of the described invention will be apparent to those skilled in the art. Examples of several such variations have been mentioned and discussed above. Further, adaptions could be made in order to form the upper part of solid-stick product P to exhibit a custom shape on its upper surfaces. For example, closure cap 60 could be formed with a curved inner upper surface, or a removable shaped insert could be placed over the upper edges of undercut portion 22 of container body 20 prior to the application of closure cap 60. Accordingly, the scope of the present invention should be considered in terms of the following claims and is understood not to be limited to the details of structure and operation described and shown in the specification and drawings.

We claim:

1. A dispensing container for solid stick-type products comprising:

(a) a substantially tubular container body having an open upper end and a base member mounted in the lower end of said container body, said base member having an aperture formed therethrough;

(b) a cup-shaped closure cap telescoped over said upper end;

(c) an internally threaded follower slidably and non-rotatably disposed within said container body for axial movement therewithin, said follower further comprising a central core having a plurality of radially disposed fin-like elements extending outwardly therefrom providing an at least partially open skeletal structure about the periphery of said central core adapted to permit axial flow of molten solid stick product therethrough during filling operations and later imbedment in and adherence to the solidified stick product; and (d) means for manually varying the axial position of said follower within said container body; said varying means further comprising an externally threaded screw stem having cooperative engagement with the internal threads of said follower, and a rotating means disposed on the lower exterior of said base member and extending into said container body through said aperture; said rotating means having a bore formed therein providing fluid communication from the exterior to the interior of said container body therethrough; and said screw stem being attached to said rotating means adjacent said bore by skeletal-structured mounting means further comprising at least one radially disposed spoke-like support arm which does not substantially block said bore and thereby permits axial flow of said molten solid stick product through said bore and said mounting means during filling operations.

2. The dispensing container of claim 1, wherein said tubular container body is substantially circular in cross-section.

3. The dispensing container of claim 1, wherein said tubular container body is substantially oval in cross-section.

4. The dispensing container of claims 2 or 3, wherein said means for varying the axial position of said follower includes a screw knob having a central bore formed therethrough, said knob being mounted on the exterior of said container body and extending into said container body through said aperture, and said screw stem being attached to said knob by said skeletal-structured mounting means.

5. The dispensing container of claim 4, wherein said base member substantially closes the lower end of said container body except for said aperture formed therethrough.

6. The dispensing container of claim 5, wherein said central core includes said internal threads of said follower.

7. The dispensing container of claim 6, wherein some of said fin-like members are connected at their distal ends by side wall structures which have a shape substantially conforming to at least a portion of the inner surfaces of said container body.

8. The dispensing container of claim 6, wherein said follower comprises a substantially dome-shaped upper surface having a central bore formed therethrough and a plurality of product anchoring sockets disposed around said central bore in said upper surface, and having said internally threaded central core attached within said central bore by said plurality of radially disposed fin-like skeletal support members.

9. The dispensing container of claim 8, wherein said follower is substantially fully retractable on said screw stem within said container body such that substantially the entire inner volume of said container body may be filled with molten solid stick product during said filling operations.

10. A dispensing container for solid stick-type products comprising:

(a) a tubular container body of substantially oval cross-section having an open upper end and a base member substantially closing the lower end of said container body, said base member having a central aperture formed therethrough;

(b) a cup-shaped closure cap telescoped over said upper end;

(c) an internally threaded follower slidably and non-rotatably disposed within said container body for axial movement therewithin, said follower being substantially fully retractable within said container body and including a central core having a plurality of radially disposed fin-like elements extending outwardly therefrom providing a partially open skeletal structure about the periphery of said central core adapted to permit axial flow of molten solid stick product therethrough during filling operations and later imbedment in and adherence to the solidified stick product; and (d) means for manually varying the axial position of said follower within said container body; said varying means further comprising an externally threaded screw stem having cooperative engagement with said internal threads of said follower, and a rotating means disposed on the lower exterior of said base member and extending into said container body through said central aperture; said rotating means having a bore formed therein providing fluid communication from the exterior to the interior of said container body therethrough; and said screw stem being attached to said rotating means adjacent said bore by skeletal-structured mounting means further comprising at least one radially disposed spoke-like support arm which does not substantially block said bore and thereby permits axial flow of said molten solid stick product through said central bore and said mounting means during filling operations.

11. The dispensing container of claim 10, wherein said central core includes said internal threads of said follower.

12. The dispensing container of claim 11, wherein some of said fin-like members are connected at their distal ends by side wall structures which have a shape substantially conforming to at least a portion of the inner surfaces of said container body.

13. The dispensing container of claim 11 wherein said follower comprises a substantially dome-shaped upper surface having a central bore formed therethrough and a plurality of product anchoring sockets disposed around said central bore in said upper surface, and having said internally threaded central core attached within said central bore by said plurality of radially disposed fin-like skeletal support members.

14. The dispensing container of claim 13, wherein said product anchoring sockets further comprise vent holes to permit escape of displaced air during bottom fill operations.

15. The dispensing container of claim 14, further comprising an exterior cover member adapted to plug said central bore following filling operations.

* * * * *

UNITED STATES PATENT AND TRADEMARK OFFICE

CERTIFICATE OF CORRECTION

PATENT NO. : 4,605,330

DATED : August 12, 1986

INVENTOR(S) : Michael J. Crowley, Arthur H. Dornbusch, Paul J. Green

It is certified that error appears in the above-identified patent and that said Letters Patent is hereby corrected as shown below:

On the Title Page:

In the "[56] References Cited" Section the following reference should be added:

4,019,654 4/1977 van Manen.....222/1

In Column 3, line 61, delete "the" and insert therefor -- The -- .

Signed and Sealed this

Twenty-fourth Day of March, 1987

*Attest:*

DONALD J. QUIGG

*Attesting Officer*

*Commissioner of Patents and Trademarks*